US005794531A

United States Patent [19]

Keller

[11] Patent Number: 5,794,531

[45] Date of Patent: Aug. 18, 1998

[54] MULTIPLE COLOR OFFSET ROTARY PRINTING PRESS WITH HORIZONTAL SLIDE ACCESS

[76] Inventor: James J. Keller, 1806 E. Main St., Mesa, Ariz. 75203

[21] Appl. No.: 779,754

[22] Filed: Jan. 7, 1997

Related U.S. Application Data

[63] Continuation-in-part of Ser. No. 577,124, Dec. 22, 1995, Pat. No. 5,590,598, which is a continuation-in-part of Ser. No. 205,288, Mar. 1, 1994, Pat. No. 5,477,780, which is a continuation-in-part of Ser. No. 33,313, Mar. 15, 1993, Pat. No. 5,289,768, which is a continuation-in-part of Ser. No. 902,875, Jun. 23, 1992, Pat. No. 5,193,458.

[51] Int. Cl.[6] ..... B41F 1/34

[52] U.S. Cl. ..... 101/479; 101/219; 101/425; 101/DIG. 35; 101/216

[58] Field of Search ..... 101/219, 178, 101/179, 180, 181, 205, 206, 207, 208, 479, DIG. 35, 425

[56] References Cited

U.S. PATENT DOCUMENTS

| | | | |
|---|---|---|---|
| 637,579 | 11/1899 | Hett | 101/479 |
| 1,514,049 | 11/1924 | Ichida | 101/137 |
| 2,231,914 | 2/1941 | Huck | 101/184 |
| 2,460,504 | 2/1949 | Huebner | 101/216 |
| 3,283,710 | 11/1966 | Zahradnik et al. | 101/408 |
| 3,516,289 | 6/1970 | MacGeorge et al. | 101/349 |
| 3,527,164 | 9/1970 | Bulk et al. | 101/137 |
| 3,598,045 | 8/1971 | Miller | 101/479 |
| 3,664,261 | 5/1972 | Dahlgren | 101/184 |
| 3,737,940 | 6/1973 | Moestue et al. | 101/425 |
| 3,785,287 | 1/1974 | Dahlgren | 101/137 |
| 3,805,700 | 4/1974 | Chambon | 101/425 |
| 3,814,014 | 6/1974 | Dahlgren | 101/408 |
| 3,876,087 | 4/1975 | Osta | 101/216 |
| 3,877,370 | 4/1975 | Hantscho | 101/216 |
| 4,051,781 | 10/1977 | Nishikawa | 101/348 |
| 4,081,723 | 3/1978 | Vetter et al. | 101/232 |
| 4,346,655 | 8/1982 | Suter et al. | 101/216 |
| 4,404,905 | 9/1983 | Simeth et al. | 101/183 |
| 4,408,525 | 10/1983 | Rebel | 101/177 |
| 4,567,824 | 2/1986 | Dahlgren | 101/183 |
| 4,572,069 | 2/1986 | Schwarzbeck | 101/216 |
| 4,802,411 | 2/1989 | Witczak | 101/216 |
| 4,973,040 | 11/1990 | Kemp et al. | 101/216 |
| 5,060,569 | 10/1991 | Gladow | 101/DIG. 35 |
| 5,085,143 | 2/1992 | Becker | 101/183 |
| 5,125,334 | 6/1992 | Marx et al. | 101/183 |
| 5,161,462 | 11/1992 | Okamura et al. | 101/207 |
| 5,176,077 | 1/1993 | DeMoore et al. | 101/216 |
| 5,215,510 | 6/1993 | Hartung et al. | 101/142 |
| 5,224,424 | 7/1993 | Layland | 101/425 |
| 5,392,710 | 2/1995 | Li | 101/349 |
| 5,467,712 | 11/1995 | Chou | 101/349 |
| 5,490,461 | 2/1996 | Beaudoin | 101/219 |
| 5,522,316 | 6/1996 | Singler | 101/479 |
| 5,528,986 | 6/1996 | Andersson et al. | 101/219 |
| 5,528,987 | 6/1996 | Andersson et al. | 101/219 |

*Primary Examiner*—Eugene H. Eickholt
*Attorney, Agent, or Firm*—Gerdere & Wynne, L.L.P.; John W. Montgomery

[57] ABSTRACT

A horizontal slide mechanism for removably replacing an inking unit in a rotary offset printing press of the type having a plate cylinder, a blanket cylinder and an impression cylinder having parallel rotational axes. The horizontal slide mechanism includes a first guide track and first slide plate mounted to the printing press and to said inking unit adjacent and parallel to the plate, blanket and impression cylinders for guided horizontal movement parallel to the plate, blanket and impression cylinder of the printing press. A second guide track and second slide plate pair are mounted between the printing press and the inking unit at another location parallel to and spaced apart a predeteremined transverse distance from the first guide track and slide plate pair for guided movement and support of the inking unit. A latching mechanism is provided by which the inking unit is releasably held in a first operating position corresponding to inking engagement.

12 Claims, 7 Drawing Sheets

MULTIPLE COLOR OFFSET ROTARY PRINTING PRESS WITH HORIZONTAL SLIDE ACCESS

CROSS-REFERENCE TO RELATED APPLICATIONS

This is a continuation-in-part of prior U.S. patent application Ser. No. 08/577,124 filed Dec. 22, 1995, which issued as U.S. Pat. No. 5,590,598 on Jan. 7, 1997; which is a continuation-in-part of prior U.S. patent application Ser. No. 08/205,288 filed Mar. 1, 1994, which issued as U.S. Pat. No. 5,477,780 on Dec. 26, 1995; which is a continuation-in-part of U.S. patent application Ser. No. 08/033,313 filed Mar. 15, 1993 issued Mar. 15, 1993 as U.S. Pat. No. 5,289,768; which is a continuation-in-part of prior U.S. patent application Ser. No. 07/902,875 filed Jun. 23, 1992, issued Mar. 16, 1993 as U.S. Pat. No. 5,193,458.

TECHNICAL FIELD OF THE INVENTION

The present invention relates to a mechanism, system and method for removing and replacing an inking unit on a rotary offset printing press, and in particular to a horizontal slide mechanism and system for moving an inking unit for access to print rollers of a press and for replaceably removing and cleaning the inking unit.

BACKGROUND OF THE INVENTION

Rotary offset printing machines have been used for a number of years. The basic mechanisms, principles, and steps of operation for modern rotary printers include chemically forming an image on a thin metal image plate. The thin image plate therearound is attached around the circumference of a plate cylinder. Ink and a water solution are applied by inking unit rollers and dampening unit rollers to the respective chemically treated areas that are to form an image on the image plate as it rotates with the plate cylinder. The plate cylinder rolls the image plate against a blanket cylinder offsetting a reverse image around the circumference of the blanket cylinder. A sheet of print paper or other material to be printed is fed into the press and gripped by an impression cylinder. The impression cylinder pulls the paper into rolling contact between the blanket cylinder and the impression cylinder. Under rolling pressure between the two cylinders, the image is imprinted from the blanket cylinder onto the paper. The imprinted image is the reverse of that on the blanket cylinder so that it is appears as originally formed on the image plate. After the paper is imprinted, it is removed from the impression cylinder gripper and transferred to a collection tray, if printing is finished. If additional colors or images are to be applied, the sheet may be transferred to one or more other impression cylinders which grip the print paper from a transfer gripper and roll the paper against a subsequent blanket cylinder for additional printing. Alternatively, in some presses, a large impression cylinder carries the sheet past one or more additional blanket cylinders which roll the next color onto the sheet.

In multi-color offset printers, each color is applied as a series of minute dots or patterns. It is extremely important to precisely locate or register the paper as it is gripped by the impression cylinders, or each of them, so that each subsequent matrix of colored dots can be properly located and coordinated with respect to other color dots to form the desired image. Quality printing requires precise location of the dots within thousandths of an inch of each other. An error in alignment of a few thousandths of an inch can produce a blurred image or an image with improperly mixed and overlapping color dots.

In the past, multiple color offset rotary printers accomplished this precise registration through careful attention to the transfer of the paper using precisely manufactured fixed diameter transfer cylinders. Usually, the transfer cylinders are large enough to carry two sheets of print paper spaced end-to-end around the circumference of the cylinder. The rotation of the transfer cylinders had to be carefully timed with respect to the rotation of the impression cylinders so that the paper when picked up by the transfer cylinders from one of the impression cylinders was carried around the transfer cylinder at precisely the correct speed and distance so that it was gripped by a subsequent impression cylinder precisely in the correct location for registration. The grippers for each impression cylinder had to be adjusted until the dots were printed precisely at the desired location.

The use of transfer cylinders has been important because of the extreme criticality of precise registration. The cylinders, once formed, have a fixed diameter and can be rotated through gears at a fixed speed. Repeatable transfers are thus made possible. However, this structure is complex and expensive. Further, it introduces associate problems. For example, smearing can result because the printed surface of the paper being transferred is directed inward on each transfer cylinder. Thus, the printed surface of the sheet faces outward toward the blanket cylinder when it is gripped by the next impression cylinder. Special coatings, special non-stick screens, and even complex systems for air cushioning the paper as it is carried around the transfer cylinder have been employed in order to minimize this smearing problem.

The cost of manufacturing multiple color offset printers has been very high because of the complexity of multiple transfer gripping mechanisms, large precision-built transfer cylinders, and non-smear mechanisms. Further, because of the need to properly adjust registration of the paper as it is received by each impression cylinder, transferred to each transfer cylinder and then received by each subsequent impression cylinder, the time and expense to set up any given multiple color offset printing job has been substantial. It is not uncommon for an operator to spend a considerable amount of time setting up a job and to use over five hundred (500) trial printing sheets before proper registration is obtained for all of the color impression cylinders. As a result, multiple color offset rotary printing has not been economically feasible for most small printing jobs requiring less than several thousand copies.

Traditional rotary offset printing presses employ inking units, including sets of rollers, which rollers roll against each other and against the printing press plate cylinders. The rollers of the inking unit carry ink from an ink source for distributing and applying appropriate quantities of a desired colored ink onto the plate cylinder. The plate cylinder holds the printing plate which attracts the ink to an image to be printed. The ink image is transferred to the blanket cylinder for imprinting it onto individual sheets of paper which are held against an impression cylinder. There is often limited access area to the plate cylinder, the blanket cylinder and impression cylinder of the rotary printing press. It has been found to be desirable to allow the inking unit to be movable for purposes of allowing easier access to the main cylinders of the printing press.

Various devices have been developed with varying degrees of success for accomplishing the task of allowing access to the main cylinder of printing presses. One such device was disclosed in U.S. Pat. No. 4,896,599, issued to the present applicant, James J. Keller, titled Swing-Away Colorhead for Offset Duplicator. Such a device provided many advantages over fixed inking unit systems. For example, that device would allow access to the plate cylinder, or to the other internal mechanisms of the press. Still, there continues to be a need for a mechanism by which the entire inking unit could be conveniently moved for access without removing the inking unit entirely, and also a mechanism which would allow the inking unit to be removed and replaced with another inking unit (e.g. an inking unit set up with a different color). Also, there was a need for providing a convenient mechanism and system by which an inking unit having been operated with one color of ink could be cleaned for use with another color of ink. Further, it has been recognized by Applicant that such a convenient mechanism for an inking unit could advantageously include sufficient support for convenient removal and replacement of an inking unit and a dampener as a connected combination or as an integrally formed unit.

SUMMARY OF THE INVENTION

It is an object of the present invention to provide a multiple color rotary printing press with an inexpensive mechanism for transferring printing sheets therethrough with accurate registration alignment at each impression cylinder. A transferable gripping bar is provided for gripping sheets to be printed. The transferrable gripping bar is provided with a registration projection. A corresponding projection receiving pocket is formed in each impression cylinder for accurately receiving the registration projection and holding the transferrable gripping bar in alignment. A conveyor band is attached to the gripper bar for moving the gripper bar from one impression cylinder to the next. Thus, a sheet of paper is gripped once by the gripper bar and is conveyed by the same gripper bar to each impression cylinder in the multiple color rotary offset printing press.

Another feature of the invention is the use of a registration projection which is a wheel having a V-shaped peripheral surface and a corresponding semi-circular shaped projection receiving pocket having a V-shaped rail corresponding to the peripheral shape of the wheel. The pocket rotates with each impression cylinder and the conveyor band carries the gripper bar to each impression cylinder so that the wheel rolls and slides into the pocket in precise registration alignment, both radially and axially with respect to the impression cylinder.

Another feature of the invention employs a registration projection on two spaced apart ends of the gripper bar with corresponding registration pockets at each axial end of the impression cylinder. A pair of parallel conveyor bands are attached at each end of the gripper bar to carry it suspended therebetween, as it is conveyed from one impression cylinder to the next. The gripper bar is attached to the conveyor band with a flexible bracket so that minor misalignment of the conveyor band with respect to precise registration is accommodated when the registration projection engages into the registration pocket. In this manner, inexpensive conveyor bands such as roller chains on sprockets or indexable belts on pulley gears can be employed as the conveyor band, even though minor deviations in the indexing of the band with respect to the rotation of the impression cylinders may result from wear or stretching and the like.

Another feature is to provide smooth positive engagement and disengagement between a registration projection wheel and receiving pockets at each impression cylinder. An entry guide is positioned at each impression cylinder to positively push the registration wheel into the receiving pocket while the paper to be printed becomes firmly engaged in printing contact between the impression cylinder and the blanket cylinder. An exit guide is also positioned at each impression cylinder to lift the registration wheels out of the receiving pockets so that the gripper bar moves smoothly away from the impression cylinder with the horizontal transfer chain. Parallel guides above and below the gripper bar hold the gripper bar in a horizontal orientation against twisting forces applied to actuate the gripper fingers.

Another feature is an actuation arm directly connected to rotate the gripper fingers between an open paper insertion position and a closed paper gripping position. The arm is actuated upwardly by a cam surface to an open position and is biased downward into a closed gripping position.

Another feature is the straight through transfer of printed sheets of paper from the gripper bar to a transfer gripper for removing and stacking printed paper.

Yet another feature is the use of idler sprockets in the return conveyor path for holding the gripper bars away from the impression cylinders. This reduces wear due to unnecessary engagement between projection wheels and receiving pockets during the return cycle.

It is an object of the present invention to provide a horizontal slide mechanism for removably replacing an inking unit in a rotary offset printing press of the type having a plate cylinder, a blanket cylinder and an impression cylinder having parallel rotational axes. The horizontal slide mechanism includes a guide track rigidly mounted to the printing press adjacent and parallel to the plate, blanket and impression cylinders. The guide track forms a predetermined shape for allowing a slide plate to move horizontally along the guide track. The slide plate is movably engaged in the guide track.

In one embodiment, a pivot mount is attached to the slide plate and is attached to the inking unit for providing a single pivot axis therebetween. The pivot axis of the pivot mount is parallel to the rotational axis of the plate cylinder. The pivot axis is spaced apart from the plate cylinder at a position for pivoting the inking unit between a first and a second pivot position, with the first pivot position corresponding to inking engagement with the plate cylinder, and the second pivot position corresponding to a spaced apart disengaged position at which said inking unit is not in engagement with the plate cylinder. A latching mechanism is provided by which the inking unit is releasably held and locked in the first pivot position corresponding to inking engagement with the plate cylinder.

In another embodiment, a first slide plate and first guide track are attached between an inking unit and a press at a first location and a second slide plate and second guide track are another location, parallel to the first slide plate and first guide track, spaced a transverse distance so that the inking unit is supported against cantilever tilting force on the first guide track and slide plate mechanism.

Preferably, the first guide track includes the first plurality of horizontally aligned rollers having a first predetermined profile shape and a second plurality of horizontally aligned rollers having a second predetermined profile shape. The first and second sets of horizontally aligned rollers are positioned parallel to each other, spaced apart a predetermined distance. The first slide plate preferably includes a first horizontal ridge having a cross-sectional shape corresponding to the reverse image of the first predetermined profile shape of the first set of rollers for rolling engagement therewith, and also including a second horizontal ridge having a predetermined cross-sectional shape corresponding to a reverse image of the second predetermined profile shape, parallel and spaced apart a predetermined distance from said first horizontal ridge, for simultaneous rolling engagement with the second set of horizontally aligned rollers.

Preferably, the second guide track and slide plate comprise a set of horizontally aligned rollers having a flat surface profile and a horizontal slide plate having a flat surface against which said rollers engage the slide plate in supported rolling contact.

It is a further object of the present invention to provide guide tracks and slide plates which overlappingly extend in opposite directions a sufficient distance to provide support for the inking unit adjacent to the printing press for access to the plate cylinder and other areas of the press without complete removal of the inking unit.

It is a further object of the invention to provide a first guide track which comprises concave V-shaped rollers with corresponding convex V-shaped profile for the horizontal ridges on the slide plate, so that the slide plate and the attached inking unit are accurately maintained parallel to the axis of the plate cylinder.

It is a further object of the invention that a latching mechanism be provided which both securely holds the inking unit against horizontal and transverse movement and in the first engaged position and which holds the inking unit securely against horizontal movement with a locking pin so that the inking unit does not inadvertently slide out of registration during operation.

It is a further object of the invention that the drive gear of the printing press automatically engages with the power receiving gear of the inking unit upon engagement in the first position and automatically disengages upon raising the inking form rollers from the plate cylinder and sliding the inking unit to the second disengaged position. Preferably, the inking unit is provided with a form roller raising mechanism by which the form rollers may be separated from the plate cylinder, and an external manual rotation knob by which the rotational position of a power takeoff gear of the inking unit can be adjusted slightly so that gear meshing with a press drive gear is accomplished without binding of either the rollers or the gears during movement from the second disengaged position to the first engaged position.

It is further object of the invention to provide a movable inking unit receiving tray having horizontal receiving guide tracks or slide plates for receiving the slide plates or guide tracks attached to the inking unit. The receiving tray is constructed so that the height of the receiving guide tracks or slide plates can be adjustably positioned so that sliding transfer of the inking unit from the printing press to the receiving tray is easily accomplished.

It is a further object of the invention to provide the receiving tray with ink cleaning capabilities by which an appropriate solvent can be directed to the ink rollers of the inking unit. Preferably, used solvent liquid can be collected and a hood is provided so that solvent vapors can also be appropriately vented.

It is a further object of the invention to provide parallel spaced-apart guide track and slide plate pairs between the press and the inking unit so that the inking unit is supported for horizontal sliding and is also supported against tilting or cantilever caused by the weight of the inking unit.

It is a still further object of the invention to provide parallel guide track and slide plate pairs between the press and an interconnected inking unit and dampening unit which parallel guide track and slide plate pairs are spaced apart a sufficient transverse distance to provide adequate support to the inking unit and dampening unit so that non-binding horizontal sliding is obtained, and also a moveable receiving tray having corresponding spaced-apart parallel guide track and slide plate pairs for slidably receiving the interconnected inking unit and dampener unit. Further, the receiving tray is preferably provided with cleaning capabilities.

BRIEF DESCRIPTION OF THE DRAWINGS

The foregoing objects, advantages, and features, as well as other objects and advantages will become more apparent with reference to the description and drawings below, in which like elements represent like numerals and in which.

DETAILED DESCRIPTION OF THE PREFERRED EMBODIMENTS

Figure 1:
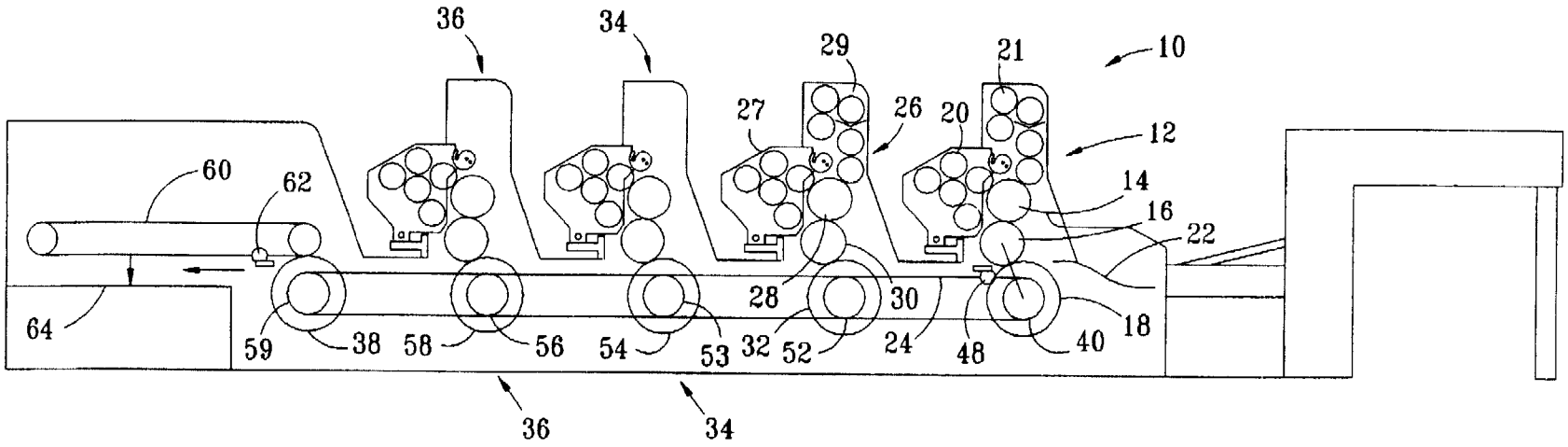
FIG. 1 is a schematic side view of one embodiment of a multiple color rotary printing press according to the present invention.

FIG. 1 shows a schematic side view of a multiple color offset rotary printing press 10. The press includes a first set 12 of color cylinders and rollers, including a first plate cylinder 14, a first blanket cylinder 16, and a first impression cylinder 18. An inking unit 20, including a plurality of inking rollers and a dampening unit 21, including a plurality of dampening rollers, are held and configured adjacent to the plate cylinder and in contact therewith. Ink and a dampening solution are thereby applied to a printing plate carried around plate cylinder 14. The image from plate cylinder 14 is applied in reverse to blanket cylinder 16. A sheet of paper 22 is fed between blanket cylinder 16 and impression cylinder 18 to imprint the image from the blanket cylinder onto the sheet 22 to be printed. In the embodiment shown in FIG. 1, the sheet 22 is conveyed on conveyor band 24 from the first set 12 to the second set 26 of color image applying cylinders. A second plate cylinder 28 receives ink from a second inking unit 27, and also receives dampening solution from a second dampening unit 29. A second color image is transferred to a second blanket cylinder 30 which in turn imprints the second color image on the sheet as it is rolled between blanket cylinder 30 and second impression cylinder 32. The sheet is carried along conveyor band 24 to each subsequent set of color cylinders and rollers 34 and last set 36. Each set operates substantially similar to the first and second sets to print an image or a portion of the image, such as one color formed of a matrix of dots or small patterns. After each matrix of dots and patterns are imprinted on sheet 22, it is transferred by conveyor band 24 to a skeleton cylinder 38 where it is released from the conveyor band 24 and carried by a delivery chain 60 to deliver the printed sheet to a collection tray 64.

Conveyor band 24 is operatively connected attached to a gripper bar 48 so that the gripper bar is moved by the conveyor band from the first impression cylinder 18 to the second impression cylinder 32 and to subsequent impression cylinders 54 and 58. Uniquely, according to one embodiment of the present invention, the sheet is continuously held by gripper bar 48 so that the sheet is not released and regripped at each impression cylinder. Rather, the gripper bar is moved from impression cylinder to impression cylinder. The conveyor band is supported with drive wheel 40 at impression cylinder 18, drive wheel 52 at impression cylinder 32, and a drive wheel 53 at each subsequent impression cylinder 54 until the last impression cylinder 58 has a corresponding drive wheel 56. The conveyor band 24 continues around a drive wheel 59 which is attached to the skeleton cylinder 38, so named because there is no impression cylinder, but rather only the wheel 59 for returning the continuous conveyor band 24. The gripper bar 48 is attached to the conveyor band 24 so that it moves around skeleton cylinder 38 past the bottom of each impression cylinder 56, 54, and 52 and is re-engaged in proper registration with impression cylinder 18 for beginning the imprinting process again.

Figure 2:
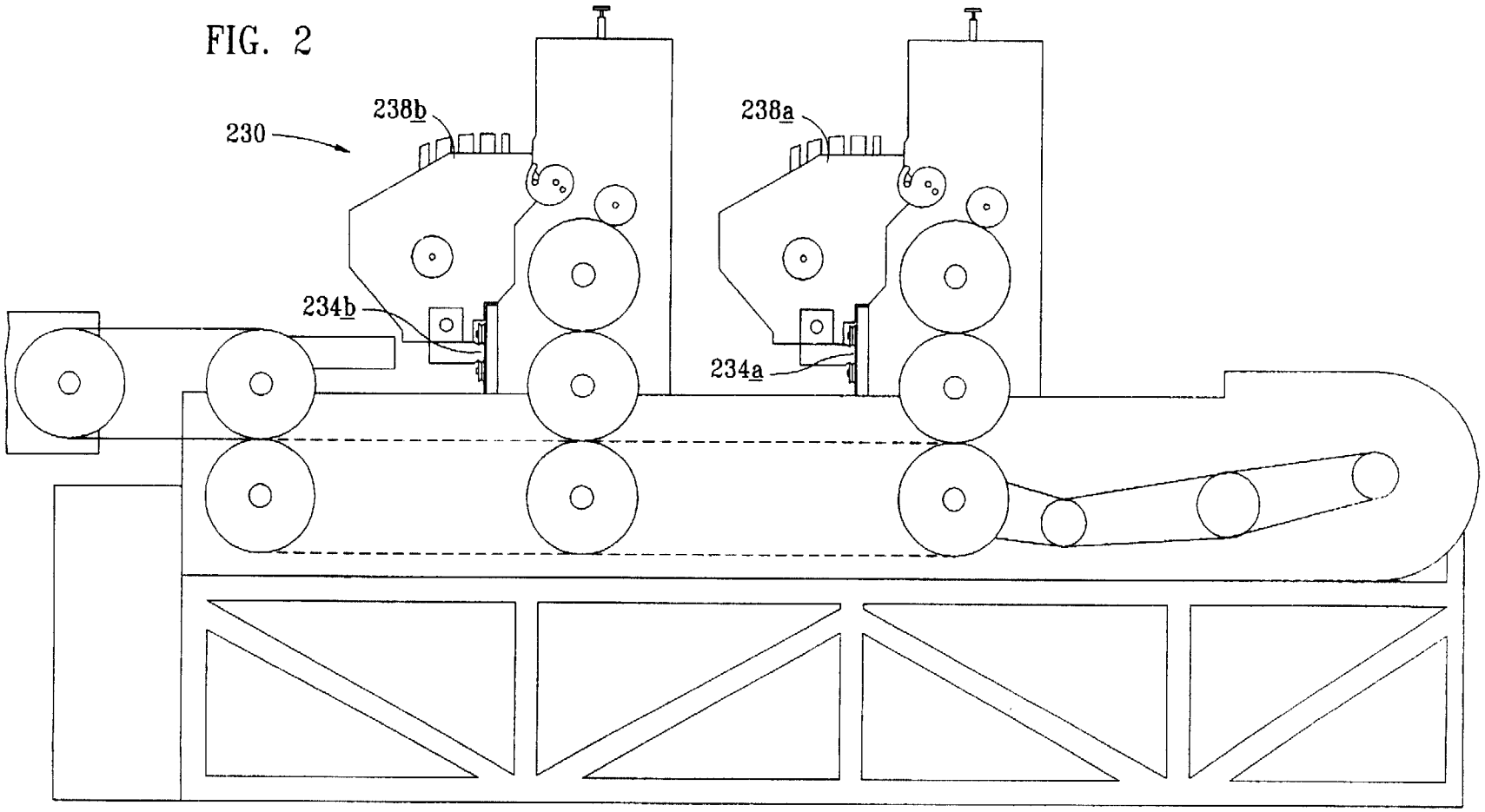
FIG. 2 is an operator side view of one embodiment of a multiple color offset printing press with horizontal slide mechanisms with inking units pivotably mounted thereon.

FIG. 2 shows an operator side view of one embodiment of a multiple color offset printing press 230. In the particular embodiment shown in FIG. 2, a two-color printing press 230 is depicted. There are horizontal slide mechanisms 234(*a*) at the first color printing position and 234(*b*) at the second color printing position. Inking units 238(*a*) and 238(*b*) are mounted on horizontal slide mechanisms 234(*a*) and 234(*b*), respectively. As will be shown in greater detail below.

Figure 3:
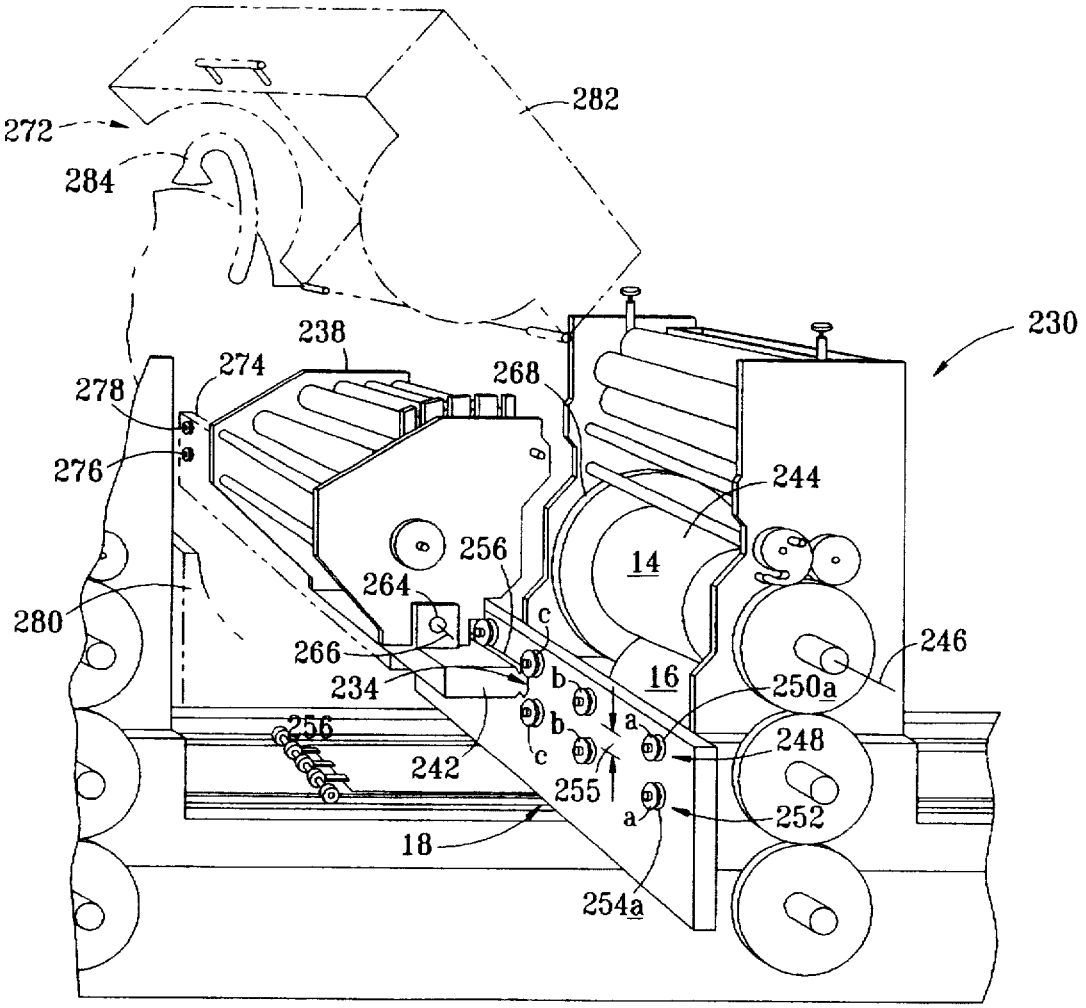
FIG. 3 is an operator partial side perspective view of the multiple color offset press of FIG. 2 with an inking unit in a supported horizontally adjacent position for access to the plate cylinder, blanket cylinder and/or impression cylinder, and further depicting a partial depiction of a receiving tray in phantom lines.

FIG. 3 shows an enlarged partial perspective view from the operators side of a multiple offset press 230 of FIG. 2. One printing station is depicted as representative of duplicate slide mechanisms 234 at each printing station, depending on the number of print stations or colors of the press. A four-color press would have four stations with four inking units 238, four slide mechanisms 234, four sets of plate, blanket and impression cylinders and four dampening units. Each slide mechanism 234 includes a guide track 240 which is parallel and adjacent to the primary printing head cylinders (i.e. the plate, blanket and impression cylinders). Slidably engaged in the guide track 240 is a slide plate 242. The guide track 240 holds the slide plate 242 parallel to the press cylinders and permits it to slide horizontally parallel to the surface 244 of the plate cylinder 14. For a uniform diameter plate cylinder, the slide plate moves parallel to the rotational axis 246 of the plate cylinder. Thus, the inventive slide mechanism 234 allows the inking unit to move transverse to the direction of motion of the sheets 18 which are being printed.

In one preferred embodiment, the guide track 240 is formed with a first set 248 of guide rollers 250 (*a–e*), all horizontally aligned with each other. The guide track 240 also includes a second set 252 of rollers 254(*a–e*) which are also horizontally aligned with each other. The second set of rollers 252 is vertically spaced apart a predetermined distance from the first set of rollers 248. Each of the first rollers 250 has a predetermined profile surface shape for providing both vertical and horizontal components of holding force, while allowing horizontal transverse movement. Concave V-shaped rollers are used in the preferred embodiment. The second rollers 254 also have a predetermined profile surface shape which provides support in both vertical and horizontal directions, while allowing transverse horizontal movement. The guide track is thereby formed between the first set and the second set of parallel rollers. The slide plate 242, preferably, has a first ridge 256 which has a profile shape corresponding to the reverse image of the profile shape of the first rollers 250 for engagement therealong. The slide plate 242 further, preferably, includes a second parallel ridge 260 which has a profile shape 262 which corresponds to the reverse image of the profile surface of the second rollers 254. The first and second parallel ridges are spaced apart a predetermined distance which corresponds to the spacing between the first and second sets of rollers so that the ridges may be "slid" between the rollers. The rollers preferably make rolling contact, rather than actual sliding contact, along the ridges. It will be understood that a guide track could be formed, as with parallel grooves, which, with proper lubrication, could permit sliding engagement. However, the rolling engagement of the slide plate with the effective guide track formed by the rollers is found to be advantageous in its smoothness and consistency of operation without requiring significant amounts of maintenance. For example, self lubricated sealed ball bearings can be used for each of the rollers 254(*a–e*) and 250(*a–e*), thereby minimizing maintenance while maximizing the rigidity of hold as well as ease of movement of the slide plate horizontally, parallel to the plate cylinder surface.

Figure 4:
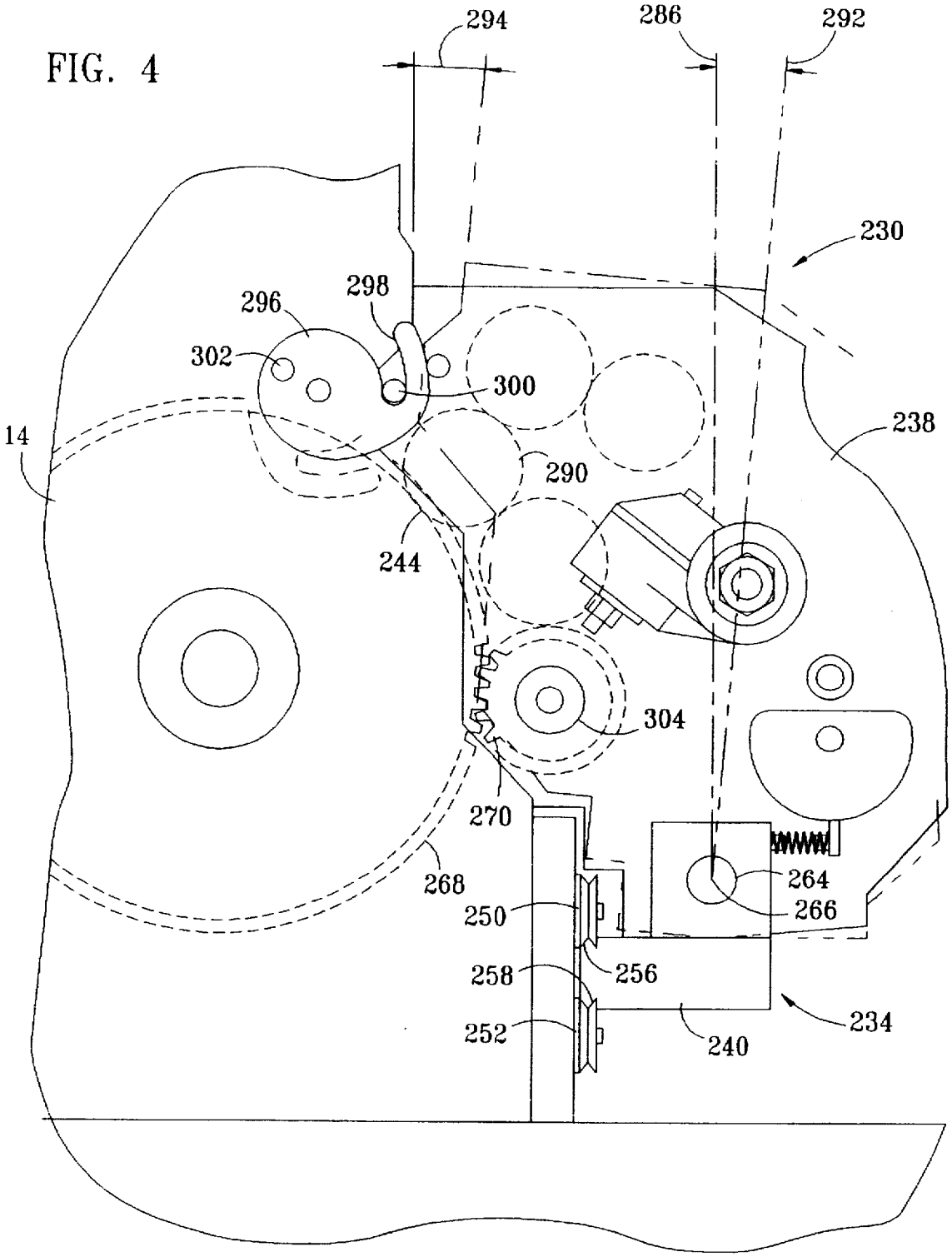
FIG. 4 is an enlarged side view showing the back side of the multiple color offset press of FIG. 2 in an engaged relationship showing a disengaged pivot position in phantom lines.

Advantageously, in the embodiment depicted in FIGS. 2, 3 and 4, the inking unit 238 is mounted to the slide plate 242 through a pivot mount 264. The pivot mount 264 provides a pivot axis 266 which is parallel to the surface 244 of plate cylinder 14. The inking unit 234, in combination with mount 264, is constructed to permit the inking unit to pivot between a first position in which the inking unit 238 is operationally engaged with the surface 244 of plate cylinder 14 to appropriately apply ink thereto. Also, inking unit drive gear 268 is engaged with the takeoff gear 270 (see FIG. 4) when inking unit 238 is pivoted into the first operationally engaged position. A second pivot position, as depicted in FIG. 3, disengages the inking unit 238 from plate cylinder 14. In this position, the inking unit can then be laterally slid on slide unit 234 to a position which is transverse to the printing sheet path. In the embodiment shown in FIG. 3, inking unit 238 is slid toward the non-operator side of the press, or to the back of the press where the operator side of the press is considered the front of the press.

In FIG. 3 there is also depicted, in partial phantom lines, a receiving tray 272 having therein a rigid receiving guide track 274. In the preferred embodiment, receiving track 274 may be constructed with upper and lower sets of guide rollers 276 and 278, respectively, which form a track substantially the same as with guide track 240. The receiving track is mounted to the receiving tray 272 in a cleaning receptacle 280 which may be provided with a movable lid 282, such as a hingeably mounted lid 282. Also, preferably, the cleaning receptacle may have attached thereto a cleaning apparatus 284, for cleaning a received inking unit. The details of construction of the receiving tray 272 will be discussed more fully below with reference to FIG. 5.

FIG. 4 depicts an enlarged partial side view showing the back side of one embodiment of a multi-color offset press 230 and inking unit 238. The inking unit 238 is shown in its first position in an operationally engaged relationship with plate cylinder 14 of press 230. The second pivot position, in which the inking unit is disengaged, is shown in phantom lines. In the first pivot position 286, both the drive gear 268 and the power takeoff gear 270 are in mesh with each other at 288. Also, at least one of the inking rollers 290 (depicted in hidden line) is engaged with the surface 244 of plate cylinder 14. In the second, or disengaged, position 292 a gap 294 is produced between the plate cylinder 14 and the inking unit 238. In the first operational position, a cam lock mechanism 296 is provided by which a progressively tighter engagement is achieved along cam ramp 298 upon rotation of lock mechanism 296. The cam lock surface 298 operates against a rigid pin 300 which is located on the inking unit 238. Preferably, duplicate cam locking units 296 are formed on both the operator side and the back side of the press, and a locking pin 302 is formed at least on the operator side by which the cam mechanism 296 is locked so that the inking unit 238 can be secured into its operationally engaged position. In order to disengage the inking unit, the lock pin 302 would first need to be disengaged and then the cam mechanism 296 could be rotated to disengage pin 300. Also, it will be understood by those skilled in the art that moving the inking unit from the disengaged to the engaged position may sometimes require rotation of the inking unit as with a knob 304, to allow gears 268 and 272 to be properly aligned for engagement.

Figure 5:
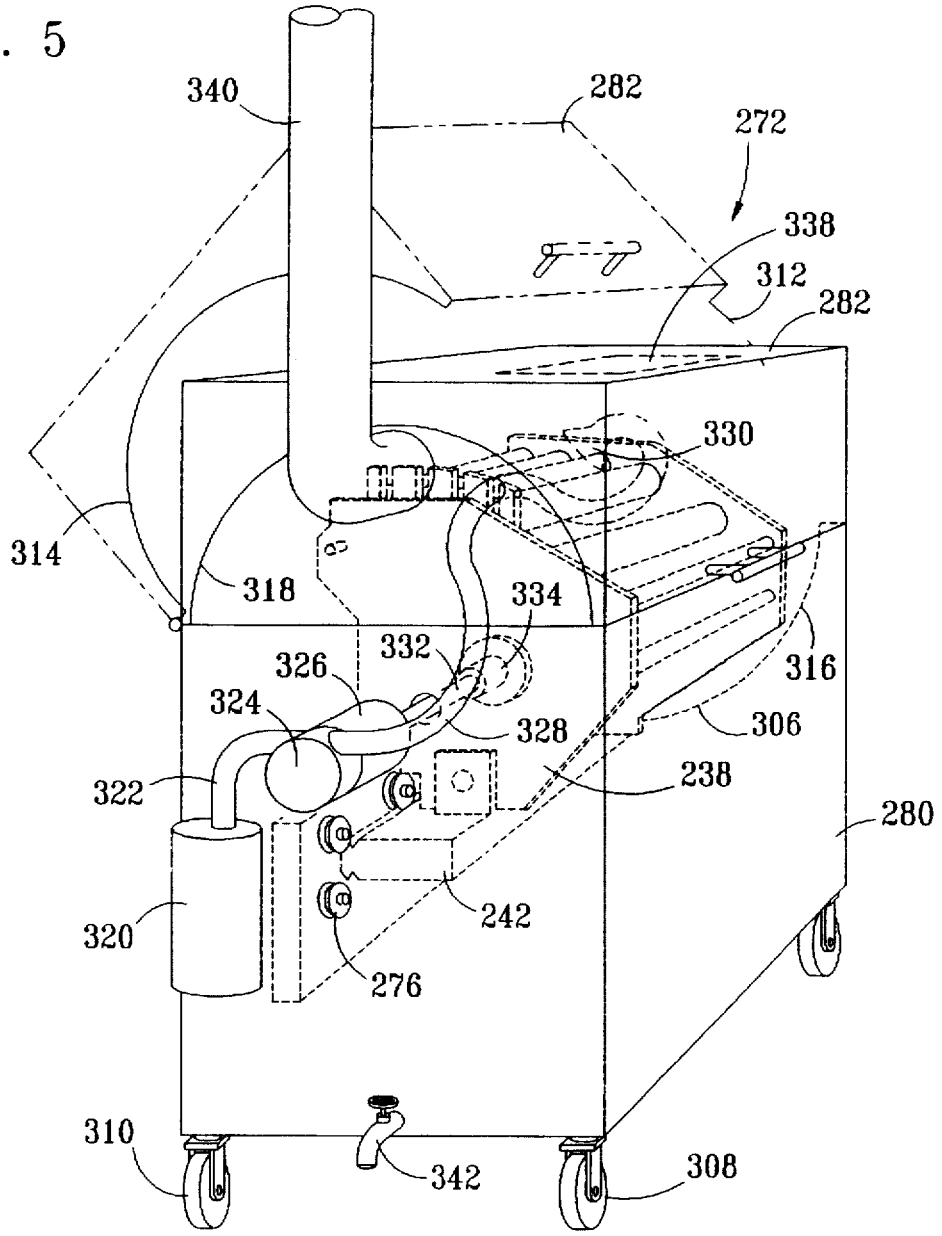
FIG. 5 is a perspective view of a slide mechanism receiving an inking unit cleaning tray.

With reference to FIG. 5, the construction of the inking unit receiving and cleaning tray 272 will be more fully understood. The inking unit 238, which continues to be pivotably mounted on slide plate 242, is received in a receiving guide track 274 which is mounted within the cleaning receptacle 280. The cleaning receptacle 280, preferably, forms a lower portion of the receiving tray 272. An opening 306 is formed which extends below the position of the receiving track 274 at one side of the cleaning receptacle 280. Sufficient opening clearance is allowed for the receiving tray 272 to be positioned immediately adjacent guide track 240, so that guide track 240 and receiving track 272 are in alignment. For this purpose, wheels 308 may be provided on the receiving tray 272 to allow is to be moved to the desired position. Also, height adjustment mechanism 400 may be provided by which the vertical position is guide track 272 can be precisely adjusted to allow easy sliding engagement. Lid 284 can be closed, as shown in FIG. 5, to totally enclose the inking unit 238. The lid is constructed with side walls 312 and 314 which correspond in shape for overlapping engagement with side walls 316 and 318 of receptacle 280.

A cleaning apparatus, generally designated 284, is advantageously provided mounted to the cleaning receptacle 280 so that the receiving and cleaning tray 272 is substantially self-contained. There is a source 320 of cleaning solvent or cleaning fluid. Preferably, the source is self-contained such as a refillable reservoir 320 for holding a cleaning fluid and which is mounted, preferably, within receptacle 280. A conduit 322 communicates the fluid to a pump 324. The pump 324 is, preferably, selectably operated with a motor 326 which may be either a low voltage DC electrical motor or, alternatively, may be a hydraulic or compressed air driven motor 326. Operator controls 327, such as a switch 327, may be positioned for easy access by the operator. The cleaning fluid from reservoir 320 is thereby pumped through conduits 322 and 328 to a directable cleaning nozzle 330. Nozzle 330 may be positioned for spraying directly onto the ink rollers of the inking unit 338 or, alternatively, may be flexibly mounted so that an operator may direct the spray as desired to particular areas to be cleaned. Also, advantageously, the motor may include a shaft 332 having a socket coupler 334 which is adapted to engage with the inking unit for driving it in rotation while the cleaning solvent is sprayed onto the ink rollers. For example, a socket which engages with positioning knob 304 may be used to accomplish this purpose. A closable access opening 328 might also be formed in lid 282 to permit the operator access for directing nozzle 330 or, alternatively, for providing a plexiglass view window by which the operation of the cleaning unit can be observed. Also, a vent 340 is provided to safely remove any evaporation of ink solvent. A drain 342 might also be provided to allow convenient removal of used solvent from the bottom of receptacle 280.

Figure 6:
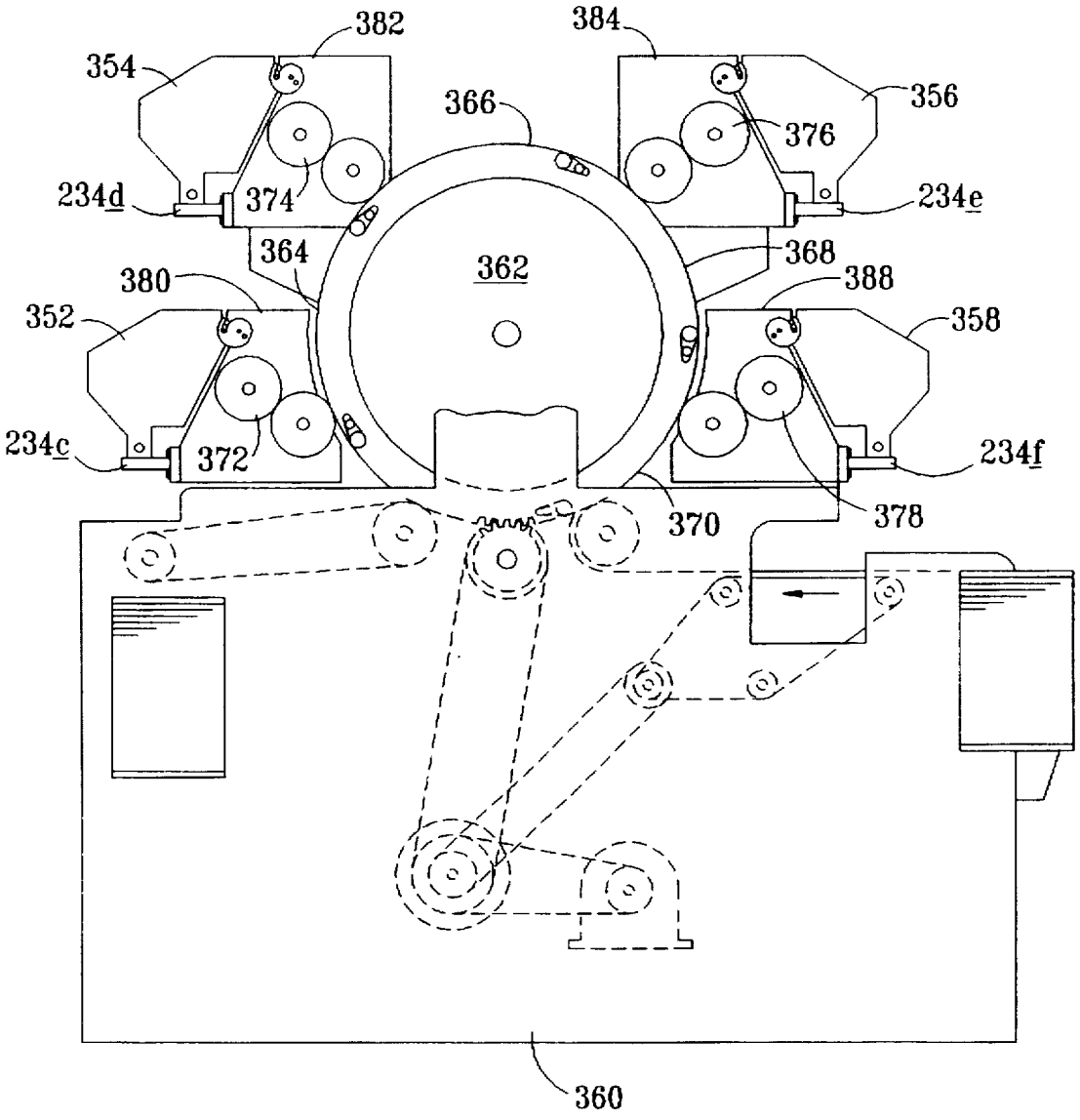
FIG. 6 is a partial cut away side elevation view of another embodiment of the slide mechanism invention on a multiple color printing press of the type having a large central impression cylinder against which a plurality of plate cylinder and blanket cylinder units operate.

FIG. 6 depicts horizontal slide mechanisms 350, 352, 354 and 356 shown attached in an alternative embodiment to a multi-color printing press 360. In this embodiment, the printing press 360 is of the type having an enlarged central impression cylinder 362 having a plurality of sheet holding areas 364, 366, 368 and 370. There are a plurality of printing units 372, 374, 376 and 378, each including a plate cylinder and a blanket cylinder. Therefore, associated with each set 372, 374, 376 and 378 of primary printing cylinders, there is a corresponding inking unit 352, 354, 356 and 358 attached, according to the present invention. Also, associated with each printing area is a dampening unit schematically depicted as 380,382,384 and 386. The horizontal slide mechanisms 234(*c*), 234(*d*), 234(*e*) and 234(*f*) are attached to inking units 352, 354, 356 and 358 with a construction corresponding to the construction as described with respect to inking unit 238, and corresponding slide mechanism 234, as discussed with respect to FIGS. 2, 3, 4 and 5, except that slide mechanisms 234(*e*) and 234(*f*) are shown in a reverse direction. For some presses, it may be possible to mount a slide mechanism 234(*e*) and 234(*f*) in the same orientation as with the slide mechanisms 234(*c*) and 234(*d*). Such a construction may be advantageous for purposes of having a consistent ink receptacle and cleaning tray construction. This is not necessary for some aspects of the invention. In any press configuration where it is more convenient to mount the inking units oriented in reverse directions, the slide mechanisms can also be advantageously reserved. In those instances, as shown in FIG. 6, either separate receiving and cleaning trays may be used or, alternatively, receiving and cleaning trays having entry thereinto from both directions may be constructed for convenient receiving of the slidable inking units from either orientation on the press.

Figure 7:
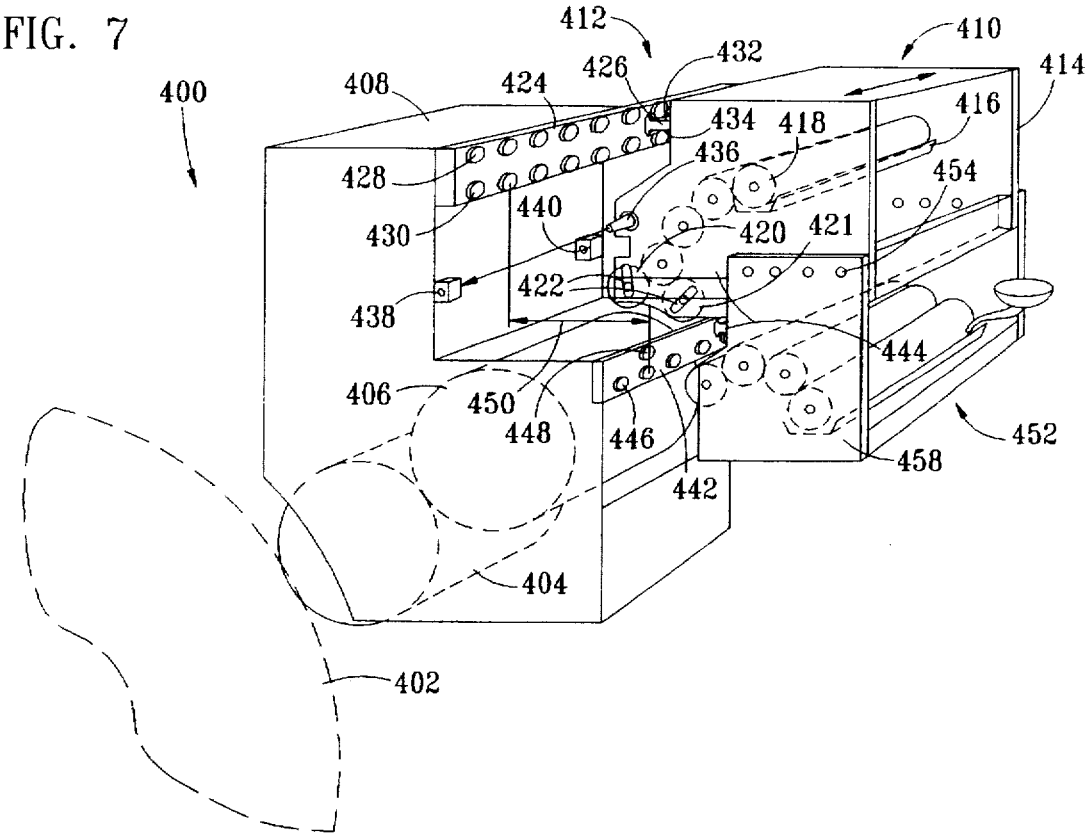
FIG. 7 is a schematic partial perspective view of an alternative embodiment of a slide mechanism having spaced-apart guide track and slide plate pairs attached between a rotary offset printing press and interconnected inking unit and dampening unit.

FIG. 7 shows a schematic partial perspective view of an alternative embodiment of a rotary offset printing press 400 which is of the type having an impression cylinder 402, at least one blanket cylinder 404, and a plate cylinder 406, within press frame 408 which are operatively mounted within press frame 408 for rotary offset printing operations. An inking unit 410 is advantageously mounted using a horizontal slide mechanism and system generally designated as 412 for replaceably removing an inking unit 410 from the rotary offset printing press 400. Structurally, the inking unit generally includes a frame 414, an ink reservoir or supply 416, a plurality of ink transfer and smoothing rollers 418 by which ink is supplied to one or more form rollers 420 and 421. Typically, the inking unit 410 is provided with a mechanism 422 by which the form rollers may be moved vertically into and out of ink transfer rolling engagement with plate cylinder 406. The form roller lifting mechanism may individually or simultaneously lift form rollers 420 and/or 421 out of rolling contact with plate cylinder 406. The horizontal slide mechanism 412 comprises a first guide track and slide plate pair, including a first guide track 424 and a corresponding first slide plate 426. In the embodiment shown in FIG. 7, the first guide track 424 is securely affixed to press frame 408 in a horizontal orientation. The first slide plate 426 is affixed to the frame 414 of the inking unit 410 in a horizontal relationship. The first guide track 424 is parallel to the plate cylinder 406 and the first slide plate 426 is parallel to the plurality of inking rollers 418 and, in particular, to the form rollers 420 and 421, so that upon sliding engagement between the guide track 424 and the slide plate 426 the form rollers 420 and 421 are in a parallel, adjacent relationship to the plate cylinder 406.

In a further preferred embodiment, as depicted in FIG. 7, the horizontal slide mechanism further comprises a second guide track and slide plate pair, including a second guide track 442 and a corresponding second slide plate 444 which are mounted to the press frame 408 and to the inking unit 410 in a horizontal relationship, again parallel to the plate cylinder 406 and to the plurality of inking rollers 418 and the form rollers 420 and 421. The second guide track and slide plate pair is spaced apart from the first guide track and slide plate pair to provide support against tilting and cantilever bending.

The embodiment of the first guide track as depicted in FIG. 7 includes an upper plurality of rollers 428 and a lower plurality of rollers 430. The rollers 428 and 430 preferably have a V-shaped surface profile which correspond in shape to an upper V-shaped trough 432 and a lower V-shaped trough 434 formed on the slide plate 426. The slide plate can, therefore, be slid between and along the upper rollers 428 and the lower rollers 430 through rolling contact in a horizontal direction while preventing motion of the inking unit in a transverse direction (i.e., a direction perpendicular to the axial direction of the press cylinders and the inking unit roller). The close fit interaction between the profile shapes of the rollers 428 and 430 and the profile of the channels 432 and 434 of the slide plate 426 also provide support against a bending moment caused by the weight of the inking unit. However, to further relieve this bending moment and the additional twisting forces imposed upon the profile shape surface of the rollers of the guide track and the slide plate ridge surfaces, the second guide track 442 and the second slide plate 444 are positioned at a transverse offset horizontal distance 450.

Figure 8:
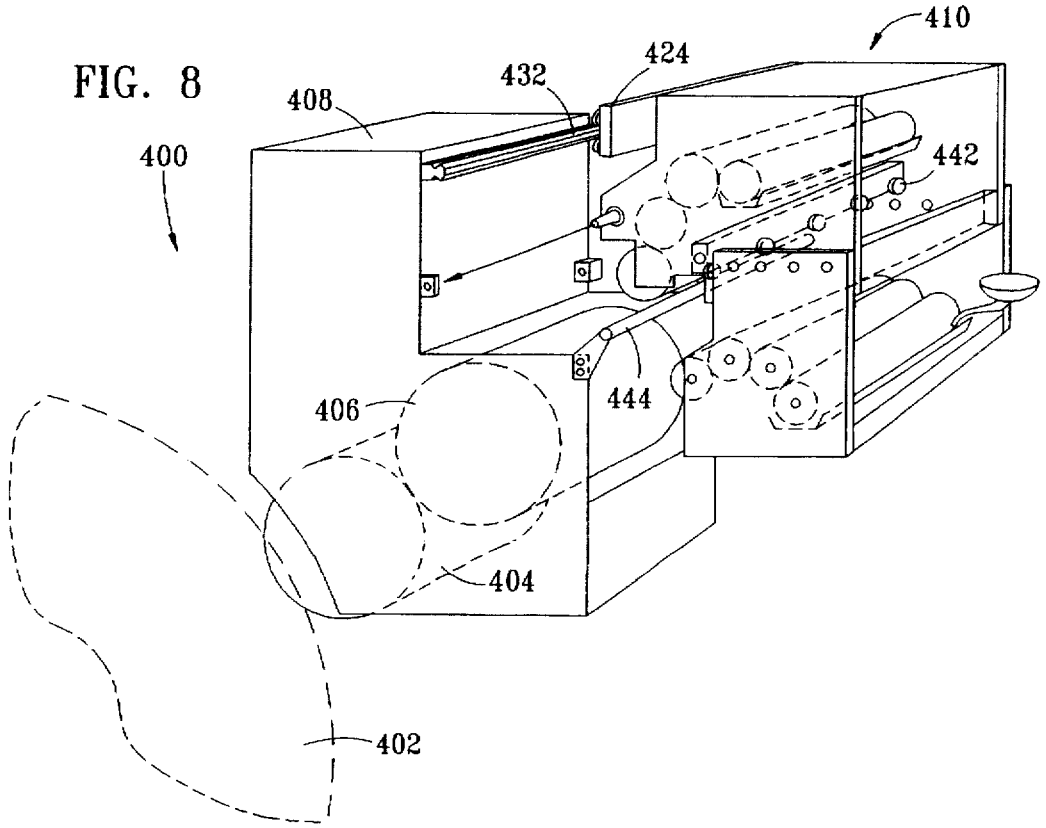
FIG. 8 is a schematic partial perspective view of another alternative embodiment of a slide mechanism attached between a rotary offset printing press and an inking unit in which alternative arrangements of slide plates and guide tracks are depicted.

The second guide track 442, as depicted in FIG. 7, comprises a plurality of horizontally aligned rollers 446. The second slide plate 444 has a horizontal surface which is positioned for corresponding rolling engagement with the rollers 446. As the rollers 446 of guide track 442 provide vertically upward support, they may conveniently be formed with a profile shape corresponding to that of the horizontal surface of the slide plate 444 which, in the embodiment shown, is flat but could also be a round bar to save space (as shown in FIG. 8 below). The horizontal surface of the second slide plate 444 may similarly be a flat surface or could also be round. In this embodiment, the support against transverse movement of the inking unit is primarily provided by the first guide track and first slide plate which preferably have V-shaped rollers and V-shaped surfaces, as discussed above. Optionally, the second guide track 442 may also be provided with additional support rollers 448 and the second slide plate is provided with an additional horizontal slide surface to provide support, in the event that an upward directed force is applied to the inking unit.

The inking unit is preferably rigidly engaged into its first operating position through the use of a taper pin 436 which engages a taper hole 438. The taper pin may be attached to the inking unit and the taper hole may be attached to the press frame, as depicted. Alternatively, a taper pin may be attached in a reverse direction to the press frame 408 and the taper hole may be formed in frame 414 of the inking unit 410, without departing from this aspect of the invention. Further, a taper hole 440 may be formed or attached to the opposite end of the press frame 408 for receiving a second taper pin (not shown) which extends inward from the opposite end of the inking unit frame 414. When the tapered pin or pins are fully engaged, a latch 441 may be engaged to prevent horizontal disengagement. With these pins engaged, as when the inking unit is in its first operating position as opposed to its second disengaged position as shown in FIG. 7, the rotational torque caused by the rolling contact between the plate cylinder and the inking unit is resisted with the rigidity of the taper pins. However, as the inking unit is moved from its first operational position to the second disengaged position, as depicted in FIG. 7, the taper pins no longer provide support against rotational moment and the lower rollers 446 provide such support through rolling engagement with the second slide plate 444. In the disengaged situation, the press will be disabled and there will be no reverse direction rotation so that lower rollers 446 adequately support the inking unit against downward motion. This takes tension and strain off of the first guide track rollers 428 and 430.

The embodiment depicted in FIG. 7 is further advantageous for purposes of affixing a dampening unit 452 directly to the inking unit 410, as at a plurality of fastener locations 454. Rigid connection of the dampening unit 452 to the inking unit may be accomplished with threaded bolt fasteners 456 or other fasteners, welding or even integral formation of the frame 414 of the inking unit and also the frame 458 of the dampening unit.

Advantageously, the embodiment of the sliding mechanism which includes first and second guide tracks and first and second slide plates provides adequate support for the inking unit and the combined weight of the dampening unit attached to the inking unit. With modern hydrophilic dampening units, the ability to conveniently remove the inking unit and the dampening unit for purposes of cleaning, and particularly removal into a receiving tray which has corresponding receiving tracks, greatly facilitates the operation and setup of rotary offset printing presses. The receiving tray may be provided with cleaning capabilities such as those depicted in FIG. 5 above. This is particularly advantageous where a multiple color rotary offset printing press is involved which may require frequent changes of color at any given position. Each separate color application position, including a plate cylinder, blanket cylinder and inking and dampening unit, can be provided with a horizontal slide mechanism similar to that depicted in FIG. 7. Both the inking mechanisms and the interconnected dampening units can be removed simultaneously for cleaning and for access to the plate cylinder. The plates can easily be removed and replaced.

With reference to FIG. 8, it will be observed by those skilled in the art that the relative positions of the guide tracks and the slide plates may be reversed. For example, the first guide track may be attached to the inking unit, the first slide plate may be attached directly to the press frame, and the second guide track may also be attached to the inking unit and/or the inking unit and dampening unit combination, and the second guide plate may be attached to the press frame. These alternative embodiments will not deviate from some of the aspects of the present invention. It will be noted in FIG. 8 that the second guide track is mounted to the inking unit and provided with a set of a plurality of support rollers above the slide plate and which rollers provide support against a horizontal surface of the second slide plate. In this embodiment, the slide plate is a round bar to advantageously minimize space used and maximize clearance and strength. This is the reverse of the embodiment shown in FIG. 7, because the direction of action of the weight of the inking unit and/or the weight of the inking unit and dampening unit combination is in a downward direction. Other combinations of the guide tracks attached to the press or to the inking unit, or the slide plates attached to the press or inking unit, can be used without departing from some of the aspects of the invention.

Thus, what has been disclosed is a horizontal slide mechanism and system for replaceably removing and cleaning inking units on a rotary offset printing press. The invention is useable with presses having single or multiple color printing capabilities. Inking units can be moved laterally out of the sheet path, both for access to the printing cylinders and also for cleaning and/or replacement with an inking unit which is set up with another desired color.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

What is claimed is:

1. A horizontal slide mechanism for removably replacing an inking unit on a rotary offset printing press of the type having a plate cylinder, a blanket cylinder and an impression cylinder having parallel rotational axes; said horizontal slide mechanism comprising:

(a) a first guide track and first slide plate pair mounted between said printing press and said inking unit parallel to said plate, blanket and impression cylinders at one location on said printing press for guided movement parallel to said plate, blanket and impression cylinders;

(b) a second guide track and second slide plate pair mounted between said printing press and said inking unit at another location parallel to and spaced apart a predetermined transverse distance from said first guide track and slide plate pair for guided movement and support of said inking unit; and (c) a latching mechanism by which said inking unit is releasably held in a first position corresponding to inking engagement.

2. A horizontal slide mechanism, as in claim 1, for removably replacing an inking unit set in a rotary offset printing press of the type having a plate cylinder, a blanket cylinder and an impression cylinder having parallel rotational axes wherein:

(a) said first guide track comprises a plurality of upper horizontally aligned rollers having an upper predetermined profile shape and a plurality of lower horizontally aligned rollers having a lower predetermined profile shape, said upper and lower sets of horizontally aligned rollers spaced apart from each other a predetermined vertical distance;

(b) said first slide plate comprises a first horizontal ridge having a cross-sectional shape corresponding to a reverse image of said upper predetermined profile shape of said rollers of said upper set of rollers for rolling engagement therewith, and a lower horizontal ridge having a predetermined cross-sectional shape corresponding to a reverse image of said lower predetermined profile shape parallel to and spaced apart said predetermined distance from said upper horizontal ridge for simultaneous rolling engagement with said lower set of horizontally aligned rollers;

(c) said second guide track comprises a second plurality of horizontally aligned support rollers positioned between said press and inking unit for providing a vertically upward support force; and (d) said second slide plate comprises a horizontal surface positioned between said press and inking unit for providing vertical upward support to said inking unit.

3. A horizontal slide mechanism, as in claim 2, wherein:

(a) said profile shape of said upper and lower rollers is a concave "V" shape, and said corresponding profile shape of said upper and lower ridges of a convex "V" shape; and (b) said second plurality of support rollers have a predetermined profile shape, and said slide plate has a corresponding reverse image cross-sectional shape horizontal surface against which said support rollers contact.

4. A horizontal slide mechanism, as in claim 1, wherein said guide tracks and said slide plates overlap in opposite directions for supporting the inking unit outboard from said press for access to the press printing cylinders without removal of the inking unit.

5. A horizontal slide mechanism, as in claim 1, wherein said latching mechanism comprises a tapered pin and tapered hole positioned between said press and said inking unit for securely holding the inking unit in a first engaged operational position.

6. A horizontal slide mechanism, as in claim 1, further comprising a drive gear on said printing press and a power takeoff gear on said inking unit, which drive gear and power takeoff gear are positioned for intermeshing engagement with said horizontal slide mechanism slid into said first position, and which gears disengage when said horizontal slide mechanism slides the inking unit to a second disengaged position.

7. A horizontal slide mechanism, as in claim 1, further comprising a receiving tray having at least one receiving track mounted horizontally therein, said receiving track having a shape corresponding to that of said first guide track for receiving the first slide plate thereinto.

8. A horizontal slide mechanism, as in claim 1, further comprising a receiving tray having at least one receiving slide plate mounted horizontally therein, said receiving slide plate having a shape corresponding to that of said first slide plate for receiving the first guide track thereinto.

9. A horizontal slide mechanism, as in claim 8, wherein said receiving tray further comprises pivot mounted wheels for adjustably and removably positioning said receiving tray adjacent to said guide track for receiving said slide plate thereinto.

10. A horizontal slide mechanism, as in claim 8, wherein said receiving tray further comprises height adjusters by which the vertical position of the receiving track can be positioned for receiving the slide plate thereinto.

11. A horizontal slide mechanism, as in claim 7, wherein said receiving tray further comprises an inking unit cleaning apparatus.

12. A horizontal slide mechanism, as in claim 11, wherein said cleaning apparatus comprises:

(a) a source of ink cleaning solvent;

(b) a selectably activatable solvent pump;

(c) a conduit extending from said solvent source to said solvent pump;

(d) a solvent spray nozzle communicatingly coupled to said selectably activatable pump for directing pumped cleaning solvent onto the inking unit.

* * * * *